US005319152A

United States Patent [19]

Konishi

[11] Patent Number: 5,319,152

[45] Date of Patent: Jun. 7, 1994

[54] CHORD INFORMATION OUTPUT APPARATUS AND AUTOMATIC ACCOMPANIMENT APPARATUS

[75] Inventor: Shinya Konishi, Hamamatsu, Japan

[73] Assignee: Kabushibi Kaisha Kawai Gakki, Mamamatsu, Japan

[21] Appl. No.: 98,491

[22] Filed: Jul. 27, 1993

Related U.S. Application Data

[63] Continuation of Ser. No. 926,261, Aug. 8, 1992, abandoned.

[30] Foreign Application Priority Data

Aug. 20, 1991 [JP] Japan ..... 3-231134
Aug. 27, 1991 [JP] Japan ..... 3-238887

[51] Int. Cl.[5] ..... G10H 1/38

[52] U.S. Cl. ..... 84/637; 84/669; 84/DIG. 22

[58] Field of Search ..... 84/602, 610, 613, 615, 84/634, 637, 650, 653, 666, 669, DIG. 12, DIG. 22

[56] References Cited

U.S. PATENT DOCUMENTS 4,226,154 10/1980 Easler ..... 84/DIG. 22
4,700,604 10/1987 Morikawa et al. ..... 84/DIG. 12
5,085,118 2/1992 Sekizuka ..... 84/637
5,105,709 4/1992 Suzuki ..... 84/615

*Primary Examiner*—Stanley J. Witkowski

*Attorney, Agent, or Firm*—Joseph C. Mason, Jr.; Ronald E. Smith; Kaoru Kawanami

[57] ABSTRACT

A chord information output apparatus according to the present invention includes a keyboard, a key depression information detector, a chord detector for detecting a chord according to key information detected by the key depression information detector, and an internal information output section for sending detected chord information to an external device. The chord information output apparatus detects a chord upon keyboard key depression, and outputs the chord as chord information to an external device. An automatic accompaniment apparatus includes a memory for storing play data, an external information input section for receiving information from an external source, a chord information converter for converting, into chord information, information received from the external information input section, a play data converter for converting play data, read from the memory, corresponding to the chord information converted by the chord information converter, and a tone generator for producing a musical tone based on the play data converted by the play data converter. The automatic accompaniment apparatus receives information from an external device, converts the information into chord information, generates tone information by converting play data read from a memory in accordance with the chord information, and produces a musical tone based on the tone information.

13 Claims, 13 Drawing Sheets

MAP (OCTAVE CODE)

MSB

| C | C# | D | D# | E | F | F# | G | G# | A | A# | B | – | – | – | – |
|---|---|---|---|---|---|---|---|---|---|---|---|---|---|---|---|

*Fig. 7A*

| SET MAP – BIT PATTERN | | NOTE |
|---|---|---|
| 1 0 0 0 0 0 0 0 | 0 0 0 0 0 0 0 0 | C |
| 0 1 0 0 0 0 0 0 | 0 0 0 0 0 0 0 0 | C# |
| 0 0 1 0 0 0 0 0 | 0 0 0 0 0 0 0 0 | D |
| 0 0 0 1 0 0 0 0 | 0 0 0 0 0 0 0 0 | D# |
| 0 0 0 0 1 0 0 0 | 0 0 0 0 0 0 0 0 | E |
| 0 0 0 0 0 1 0 0 | 0 0 0 0 0 0 0 0 | F |
| 0 0 0 0 0 0 1 0 | 0 0 0 0 0 0 0 0 | F# |
| 0 0 0 0 0 0 0 1 | 0 0 0 0 0 0 0 0 | G |
| 0 0 0 0 0 0 0 0 | 1 0 0 0 0 0 0 0 | G# |
| 0 0 0 0 0 0 0 0 | 0 1 0 0 0 0 0 0 | A |
| 0 0 0 0 0 0 0 0 | 0 0 1 0 0 0 0 0 | A# |
| 0 0 0 0 0 0 0 0 | 0 0 0 1 0 0 0 0 | B |

*Fig. 7B*

| TIMBRE NUMBER | CHORD TYPE |
|---|---|
| 100 | MAJOR |
| 101 | MINOR |
| 102 | 7TH |
| 103 | MINOR 7TH |
| 104 | 6TH |
| 105 | MAJOR 7TH |
| 106 | −5 |
| 107 | MINOR −5 |
| 108 | MINOR MAJOR 7TH |
| 109 | SUS4 |
| 110 | ADD9 |
| 111 | MINOR ADD9 |
| 112 | 13TH |
| 113 | −13TH |
| 114 | DIM |
| 115 | AUG |
| ⋮ | ⋮ |

*Fig. 8*

| OCTAVE CODE (BINARY) | NO. | CHORD TYPE |
|---|---|---|
| 10000000 00000000 | 0 | MAJOR |
| 10001000 00000000 | 1 | MAJOR |
| 10001001 00000000 | 2 | MAJOR |
| 10000001 00000000 | 3 | MAJOR |
| 10010000 00000000 | 4 | MINOR |
| 10010001 00000000 | 5 | MINOR |
| 10000000 00100000 | 6 | 7TH |
| 10001000 00100000 | 7 | 7TH |
| 10001001 00100000 | 8 | 7TH |
| 10010000 00100000 | 9 | MINOR 7TH |
| 10001001 01000000 | 10 | 6TH OR MINOR 7TH |
| 10001000 00010000 | 11 | MAJOR 7TH |
| 10001001 00010000 | 12 | MAJOR 7TH |
| 10010001 01000000 | 13 | MINOR6 OR MINOR7 FLAT5 |
| 10010001 01000000 | 14 | MINOR6 OR MINOR7 FLAT5 |
| 10010001 00010000 | 15 | MINOR MAJ7 |
| 10000101 00000000 | 16 | SUS4 |
| 10000101 00100000 | 17 | 7TH SUS4 |
| 10101001 00000000 | 17 | ADD9 |
| 10110001 00000000 | 18 | MINOR ADD9 |
| 10001000 01100000 | 19 | 13TH |
| 10001000 10100000 | 20 | FLAT 13TH |
| 10010010 00000000 | 21 | DIM |
| 10010010 01000000 | 22 | DIM |
| 10001000 10000000 | 23 | AUG |

*Fig. 9*

CHORD INFORMATION OUTPUT APPARATUS AND AUTOMATIC ACCOMPANIMENT APPARATUS

This is a continuation of copending application Ser. No. 07/926,261 filed on Aug. 6, 1992 and now abandoned.

BACKGROUND OF THE INVENTION

1. Field of the Invention

The present invention relates to a chord information output apparatus that detects chords and outputs them as chord information to an external device, and to an automatic accompaniment apparatus that performs automatic accompaniment in accordance with chord information, etc. received from external sources.

2. Description of the Related Art

Many compact automatic accompaniment apparatuses that do not have keyboards have been developed and are in use today. These automatic accompaniment apparatuses provide automatic accompaniment based on chord information that is input by means other than keyboards.

Inputting chord information to such automatic accompaniment apparatuses is conventionally performed using keypads or other small terminal assemblies.

Players who are accustomed to using keyboards, however, feel uncomfortable using keypads, and cannot enter chord information with them smoothly.

Further, to reduce the sizes of keyboardless automatic apparatuses, very small terminals are used for chord information entry. These small terminals make use of the apparatuses inconvenient, and chord information input clumsy.

Recently, electronic musical instruments that have keyboards and that incorporate automatic accompaniment apparatuses have been developed. Such electronic musical instruments are so designed that one part of a keyboard (e.g., the lower half, the LOWER keyboard) can be used to enter chord information, and the other part (e.g., the upper half, the UPPER keyboard) can be used to enter, or play, a melody. These electronic musical instruments produce musical tones using chord information entered via their LOWER keyboards and accompany melodies entered, or played, on their UPPER keyboards.

Since a player can use the keyboard of such an electronic musical instrument to input chord information, ease of operation is increased. At the same time, however, the use of part of the keyboard for chord information input reduces proportionately the key range available for entering, or playing, a melody.

SUMMARY OF THE INVENTION

To overcome the above shortcomings, it is an object of the present invention to provide a chord information output apparatus that supplies chord information, which is detected following key depression, to an external device such as a keyboardless automatic accompaniment apparatus or an electronic musical instrument that has a keyboard and that incorporates an automatic accompaniment apparatus, so that a keyboardless automatic accompaniment apparatus can receive chord information without using its own input means, and so that the full key range of an electronic musical instrument that incorporates an automatic accompaniment apparatus can be used to play a melody.

It is another object of the present invention to provide an automatic accompaniment apparatus that can perform automatic accompaniment using chords that are detected based on information received from an external source.

To achieve the first object, a chord information output apparatus according to the present invention comprises a keyboard; a key depression information detector for detecting key depression on the keyboard; a chord detector for detecting a chord according to key information detected by the key depression information detector; and an internal information output section for sending to an external device chord information detected by the chord detector.

A chord information output apparatus of the present invention detects a chord upon keyboard key depression, and outputs the chord as chord information to an external device.

When chord information sent from a chord information output apparatus is to be supplied to, for example, a keyboardless automatic accompaniment apparatus, the chord information can be input to the automatic accompaniment apparatus by the keyboard of the chord information output apparatus rather than by the input means of the automatic accompaniment apparatus. Since players can enter chord information through familiar keyboard operation, smooth entry of chord information is possible.

And when chord information output by a chord information output apparatus is supplied to, for example, an electronic musical instrument that has a keyboard and that incorporates an automatic accompaniment apparatus, part of the instrument's keyboard does not have to be used for chord information entry and the full key range of the keyboard can be used to play a melody.

To achieve the second object, an automatic accompaniment apparatus according to the present invention comprises a memory for storing play data; an external information input section for receiving information from an external source; a chord information converter for converting, into chord information, information received from the external information input section; a play data converter for converting play data, read from the memory, corresponding to the chord information converted by the chord information converter; and a tone generator for producing a musical tone based on the play data converted by the play data converter.

An automatic accompaniment apparatus according to the present invention receives, for example, key information as data from an external device, converts the key information into chord information, generates tone information by converting play data read from a memory in accordance with the chord information, and produces a musical tone based on the tone information.

Therefore, without using its own chord information input means, such as a keypad or a small terminal assembly, an automatic accompaniment apparatus can receive chord information that is input via, for example, the keyboard of an externally connected electronic musical instrument, and can smoothly perform automatic accompaniment.

BRIEF DESCRIPTION OF THE DRAWINGS

FIGS. 7A and 7B are diagrams for explaining a map preparing process of the embodiment of the present invention;

FIG. 8 is a diagram for explaining correlation of timbre numbers and chord types according to the embodiment of the present invention;

FIG. 9 is a diagram for explaining a chord detection method according to the embodiment of the present invention;

DETAILED DESCRIPTION OF THE PREFERRED EMBODIMENTS

(1) Chord Information Output Apparatus

Figure 1:
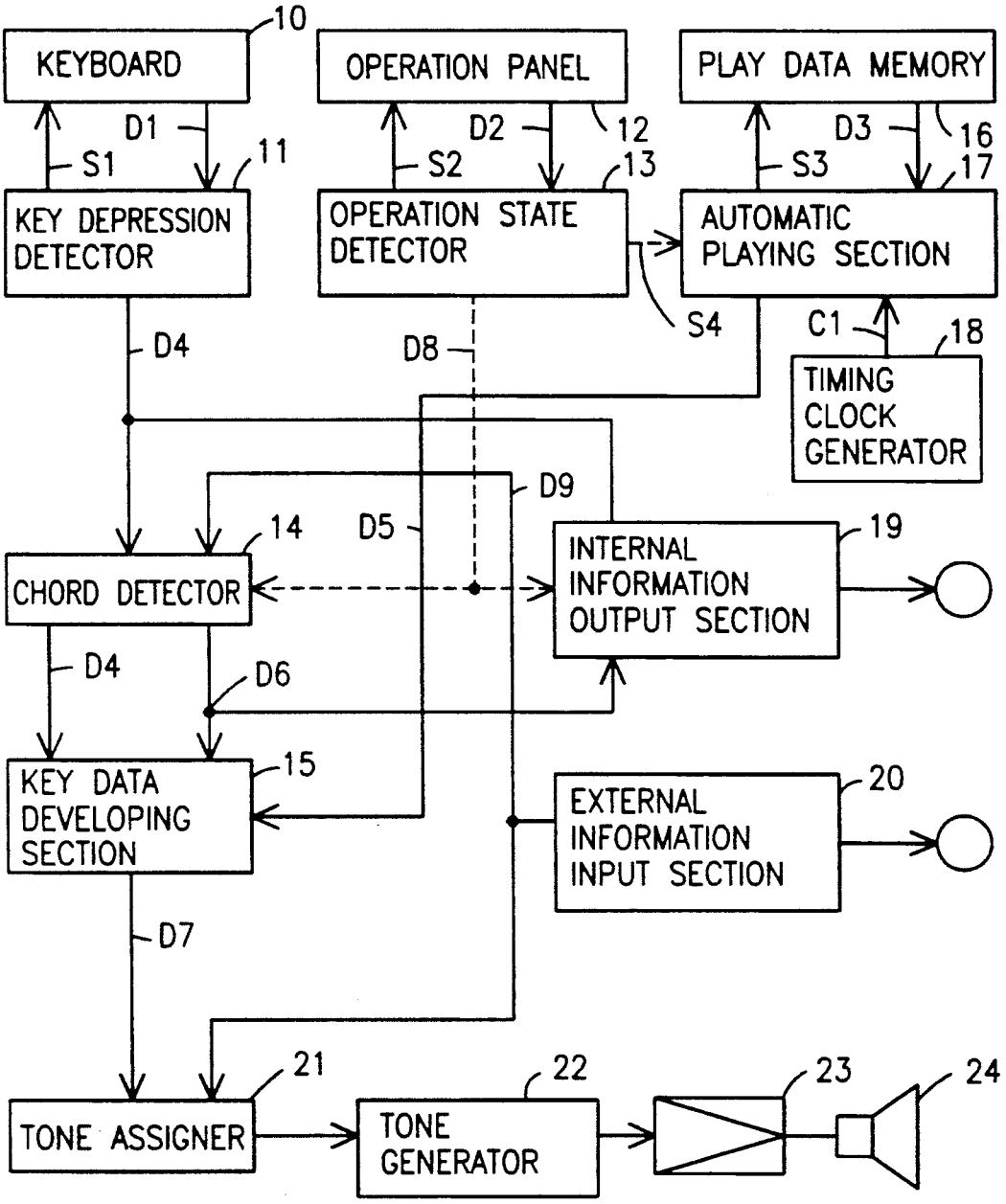
FIG. 1 is a schematic block diagram illustrating the general arrangement of one embodiment of a chord information output apparatus according to the present invention.

FIG. 1 is a schematic block diagram showing the general structure of one embodiment of a chord information output apparatus according to the present invention.

A keyboard 10 has multiple keys, and key switches that open and close upon key depression/release. The keyboard 10 is used by players to generate desired musical tones, or to release them. Through key depression/release, chord information is input and a melody is played.

The keyboard 10 receives a key scan signal S1 from a key depression detector 11. The keyboard 10 scans the key switches in response to the key scan signal S1, and outputs key scan data D1 indicating depression/release of individual keys. The key scan data D1 is sent to the key depression detector 11.

The key depression detector 11 sends the key scan signal S1 to the keyboard 10, and receives the key scan data D1 from the keyboard 10. The key depression detector 11 then analyzes the received key scan data D1 to detect key depression on the keyboard 10. The key depression detector 11 supplies the key depression information as key data D4 to a chord detector 14 and an internal information output section 19.

An operation panel 12 has various switches for controlling the chord information output apparatus, a display, etc. (none of them shown). The switches include a START/STOP switch, an AUTO1 switch, and an AUTO2 switch (none of them shown), which are specified for this embodiment, as well as the general switches provided for an electronic musical instrument, e.g., a timbre select switch, a rhythm select switch, and a volume switch.

The START/STOP switch is depressed to start or stop automatic playing performance. This switch is a toggle switch and its state changes each time it is depressed.

The AUTO1 and AUTO2 switches are used to select chord detection types. The AUTO1 switch is used to select detection method 1, i.e., use of the LOWER keyboard for chord detection. This detection type is hereafter termed "normal detection."

The AUTO2 switch is used to select detection method 2, i.e., use of the full key area, including the melody area, for chord detection. This detection type is hereafter termed "all-key detection."

Chord detection types other than normal detection and all-key detection, such as chord detection using only one key, can also be provided.

A panel scan signal S2 is sent to the operation panel 12 by an operation state detector 13. In response to the panel scan signal S2, the switches on the operation panel 12 are scanned and the operation panel 12 outputs panel scan data D2 that indicates the settings of the switches. The panel scan data D2 is transmitted to the operation state detector 13.

The operation state detector 13, which sends the panel scan signal S2 to the operation panel 12, receives the panel scan data D2 that the operation panel 12 outputs in response to the panel scan signal S2. The operation state detector 13 analyzes the received panel scan data D2 to detect the settings of the switches on the operation panel 12. When the operation state detector 13 detects information that indicates that either the AUTO1 switch or the AUTO2 switch is set, it supplies that information as chord detection type data D8 to the chord detector 14 and the internal information output section 19.

Based on the key data D4 from the key depression detector 11, the chord detector 14 detects a chord using the chord detection type data D8 received from the operation state detector 13. The output of the chord detector 14 is sent as chord data D6 to a key data developing section 15 and the internal information output section 19.

The chord detector 14 supplies the original, unchanged, key data D4 that it receives from the key depression detector 11 to the key data developing section 15. The chord detector 14 receives external data D9, consisting of chord detection type data and key data, from an external information input section 20. The chord information output apparatus in this embodiment can therefore detect chords, with which to perform automatic accompaniment, using information received from an external device.

Based on the chord data D6 and key data D4 from the chord detector 14, the key data developing section 15 performs a predetermined conversion of the play data D5 it receives from the automatic playing section 17, and produces tone data D7. More specifically, upon receipt from the automatic playing section 17 of the play data D5, prepared, for example, with "C" as a base reference, the key data developing section 15, using the chord data D6 received from the chord detector 14, develops the play data D5 to obtain a predetermined code, thus producing the tone data D7. The tone data D7 is then supplied to a tone assigner 21.

A play data memory 16 is a storage area for automatic play data that is used for automatic performance. The play data memory 16 consists of, for example, a read only memory (hereafter referred to as "ROM").

With the inclusion of key data (key number) KEY, or measure information, or an END mark, step time STEP, gate time GATE and velocity VELO serve as a unit of play data. A plurality of these play data constitute automatic play data. The automatic play data are stored in the play data memory 16.

The key number KEY, which denotes one of the individually numbered keys of a keyboard, designates a pitch. The measure information indicates the end of a measure. The END mark is information indicating the end of the automatic play data.

The step time STEP is information for designating tone-on time in a measure. The gate time GATE designates tone duration. The velocity VELO is information for designating the loudness of a musical tone to be produced.

A read signal S3 is supplied from the automatic playing section 17 to the play data memory 16, which in turn outputs play data D3 in response to the read signal S3. The play data D3 is sent to the automatic playing section 17.

The automatic playing section 17 performs an automatic playing process when the state of the START/-STOP switch on the operation panel 12 is ON. That is, when the operation state detector 13 determines that the START/STOP switch state is ON, a signal S4 indicating that state is sent to the automatic playing section 17. The automatic playing section 17 sends the read signal S3 to the play data memory 16. The play data D3, which is read from the play data memory 16 in response to the read signal S3, is supplied as play data D5 by the automatic accompaniment section 17 to the key data developing section 15. The above described process for developing the key data is then performed to produce tone information, so that automatic playing begins.

A timing clock generator 18 serves to supply a read timing clock C1 to the automatic playing section 17. In synchronism with the read timing clock C1, the automatic playing section 17 reads play data from the play data memory 16 and performs automatic playing.

The internal information output section 19 is an interface circuit. Following receipt of an instruction from the operation panel 12, the internal information output section 19 outputs to an external device the key data D4 that is received from the key depression detector 11, the chord data D6 that it received from the chord detector 14, or the chord detection type information that it received from the operation state detector 13. An externally connected apparatus, such as an electronic musical instrument having an automatic accompaniment function, receives a signal from the internal information output section 19 and performs a predetermined process on that signal, thereby accomplishing automatic accompaniment or melody performance.

The external information input section 20 is an interface circuit that receives information from an external source. The information that the external information input section 20 receives, chord detection type information and key data, is sent to the chord detector 14 and the tone assigner 21 as external data D9.

In order to generate musical tones, the tone assigner 21 assigns tone-ON channels to the tone data D7 sent from the key data developing section 15, or to the external data D9 sent from the external information input section 20. The tone information to which a tone-ON channel is assigned by the tone assigner 21 is supplied to a tone generator 22.

Upon receipt of the tone information from the tone assigner 21, the tone generator 22 reads tone wave data and envelope data from a wave memory (not shown), and adds an envelope to the read-out tone wave data to output the resultant data as a tone signal. This tone signal is sent to an amplifier 23.

The amplifier 23 amplifies the received tone signal by a predetermined gain, and then supplies the resultant signal to a loudspeaker 24. The loudspeaker 24 is a well known transducer that converts an electric signal into an acoustic signal.

With such an arrangement, the detailed operation of the embodiment according to the present invention will now be described referring to flowcharts in FIGS. 2 to 6 and explanatory diagrams in FIGS. 7 to 9.

Figure 2:
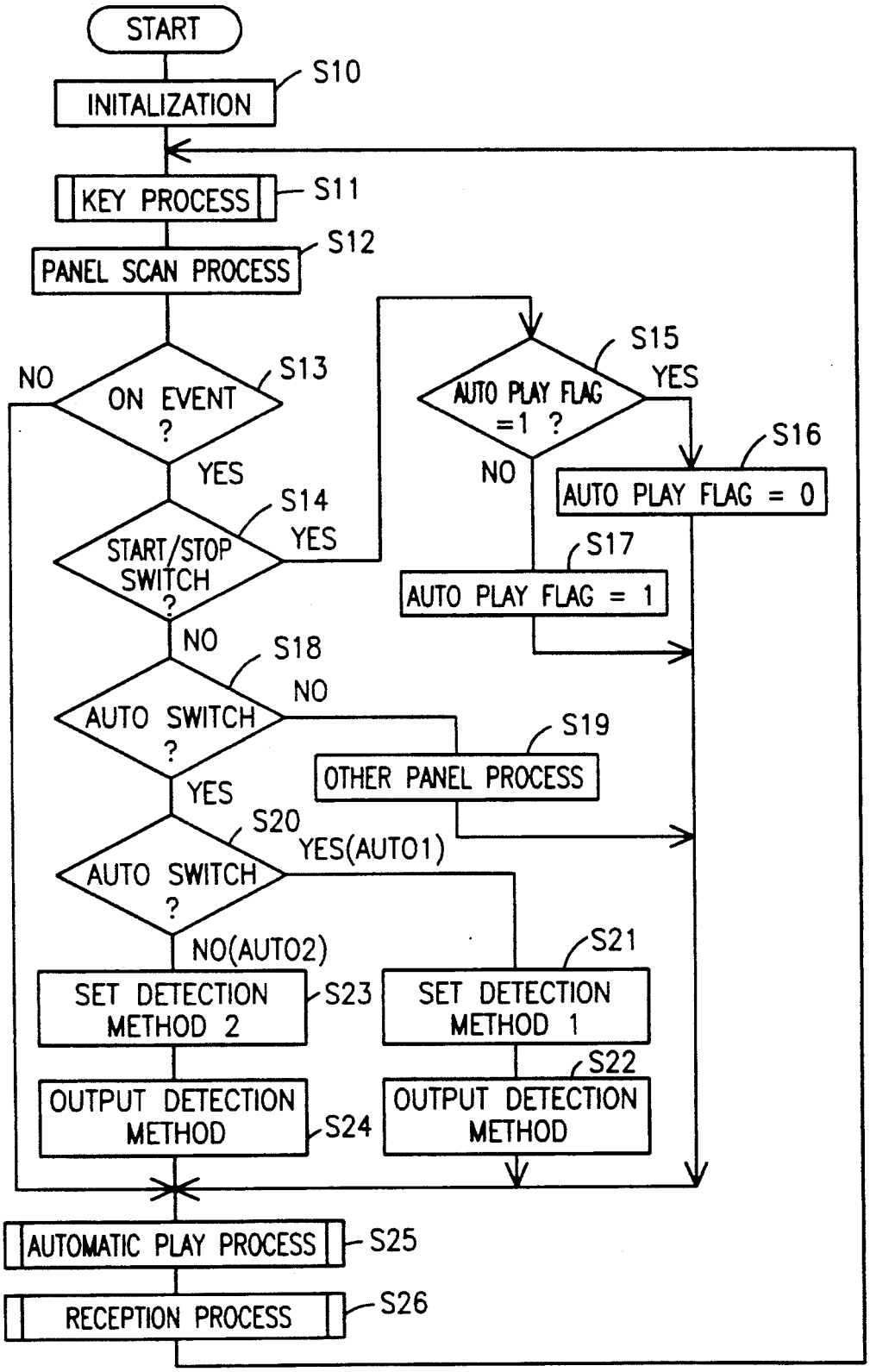
FIG. 2 is the main routine of a flowchart showing the operation process of the embodiment of the chord information output apparatus according to the present invention.

When power is switched on, an initialization process is performed as shown in the flowchart in FIG. 2 (step S10). This process establishes the initial internal state of the tone generator 22 and prevents unwanted musical tones from being produced when power is switched on, and sets the initial values of a buffer, a register, a counter, a flag, etc. which are defined in a random access memory (not shown; hereafter referred to as "RAM").

When the initialization is completed, a key process is performed (step S11). During this process, tone generation/release upon key depression/release on the keyboard 10 is performed, while chords are detected by a selected detection method, and the detected chord information is sent to an external device. The details of the key process will be described later.

Then, a panel scan process is performed (step S12). More specifically, the operation state detector 13 fetches the panel scan data D2 from the operation panel 12 and stores it in the RAM (not shown).

A check is then performed to determine whether or not an ON event has occurred at the operation panel 12 (step S13). That is, the current panel scan data D2, fetched from the operation panel 12 and held in the RAM, is compared with the previously fetched panel scan data D2, to determine whether a switch has been newly set ON.

When in step S13 it is found that no ON event has occurred, the procedure branches to step S25 and moves to an automatic playing process.

When it is found that an ON event has occurred, a check is made to determine whether or not the switch in the ON state is the START/STOP switch (step S14). In other words, a check is made to determine whether the bit in the panel scan data D2 that corresponds to the START/STOP switch has changed from "0" to "1."

If the switch in the ON state is the START/STOP switch, the status of the automatic playing flag is then checked (step S15). If the automatic playing flag is set to "1", this flag is reset to "0" (step S16), and the procedure shifts to the automatic playing process in step S25. In this case, the automatic playing process in the automatic playing process routine is not performed.

If the automatic playing flag is not "1", the flag is set to "1" (step S17), and the flow moves to the automatic playing process in step S25. In this case the automatic playing process in the automatic playing process routine is performed.

Through the processes in steps S14 to S17, the toggle function of the START/STOP switch is accomplished. The automatic playing flag is used to indicate whether the play mode of the chord information output apparatus is automatic or normal. The automatic playing flag is provided in the RAM (not shown).

When the switch in the ON event in step S14 is not the START/STOP switch, a check is made to determine whether the ON switch is one of the AUTO switches, i.e., the AUTO1 switch or the AUTO2 switch (step S18).

If it is determined that the ON switch is one of the AUTO switches, a further check is made to determine which AUTO switch is in the ON state (step S20). If the AUTO1 switch is the one that is ON, a flag is set to indicate that detection method 1 will be used for the following chord detection (step S21). Chord detection type information, indicating that a chord will be detected using detection method 1, is output through the internal information output section 19 to an external device (step S22). The procedure then branches to step S25 to move to the automatic playing process.

If it is determined that the AUTO1 switch is not ON, it is then assumed that the AUTO2 switch has been depressed and a flag is set to indicate that detection method 2 will be used for the following chord detection (step S23). Chord detection type information, indicating that a chord will be detected using detection method 2, is output through the internal information output section 19 to an external device (step S24). The procedure then branches to step S25 to move to the automatic playing process.

The external device will determine by which detection method sequentially received chord information have been detected.

If it is found in step S18 that no ON event has occurred at either AUTO switch, processing associated with an ON-event switch is performed (step S19). The processing includes, for example, timbre selection, rhythm selection or volume control. Program control then branches to step S25 to shift to an automatic playing process.

After the automatic playing process in step S25 and a reception process in step S26 are performed, program control returns to step S11, and the above-described processes are repeated.

The automatic playing process in step S25 will now be explained. This process is performed mainly by the automatic playing section 17.

Figure 3:
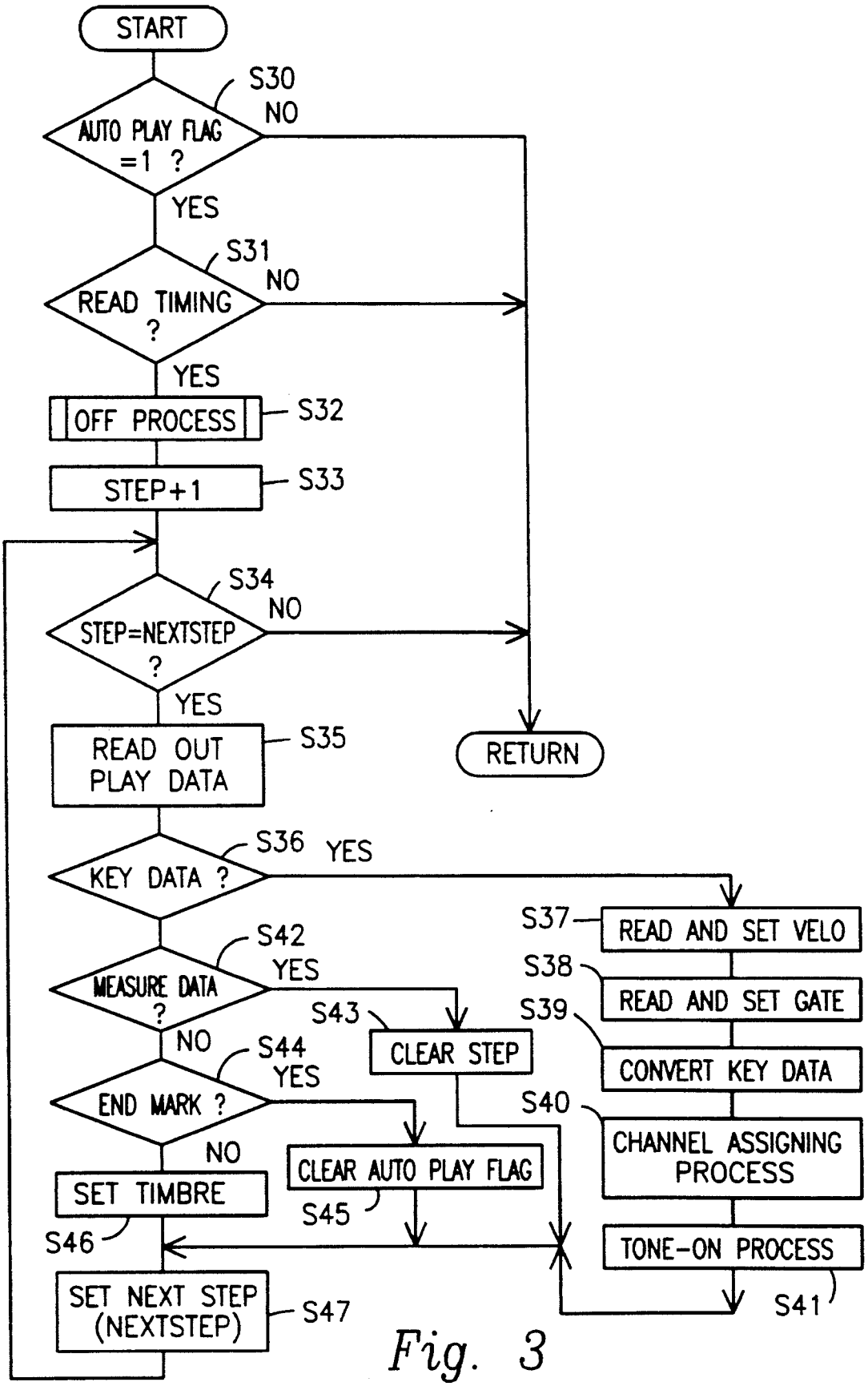
FIG. 3 is a flowchart for explaining the automatic playing process in FIG. 2.

FIG. 3 is a flowchart showing the automatic playing process. During this process, a check is performed to determine if an automatic playing flag is set to "1" (step S30). When the automatic playing flag is not set to "1", program control returns from the automatic playing process routine without performing the following processes. These procedures will be followed when an instruction is entered via the START/STOP switch of the operation panel 12 to stop automatic playing.

If, in step 30, the automatic playing flag is found to be set to "1", a check is made to determine whether or not it is time to read play data (step S31). More specifically, this process checks for a read timing clock C1, which is output by the timing clock generator 18, to determine whether or not it is time to read play data from the play data memory 16. When it is not yet time to perform a read, the following processes are not performed and program control returns to the automatic playing process routine.

Figure 4:
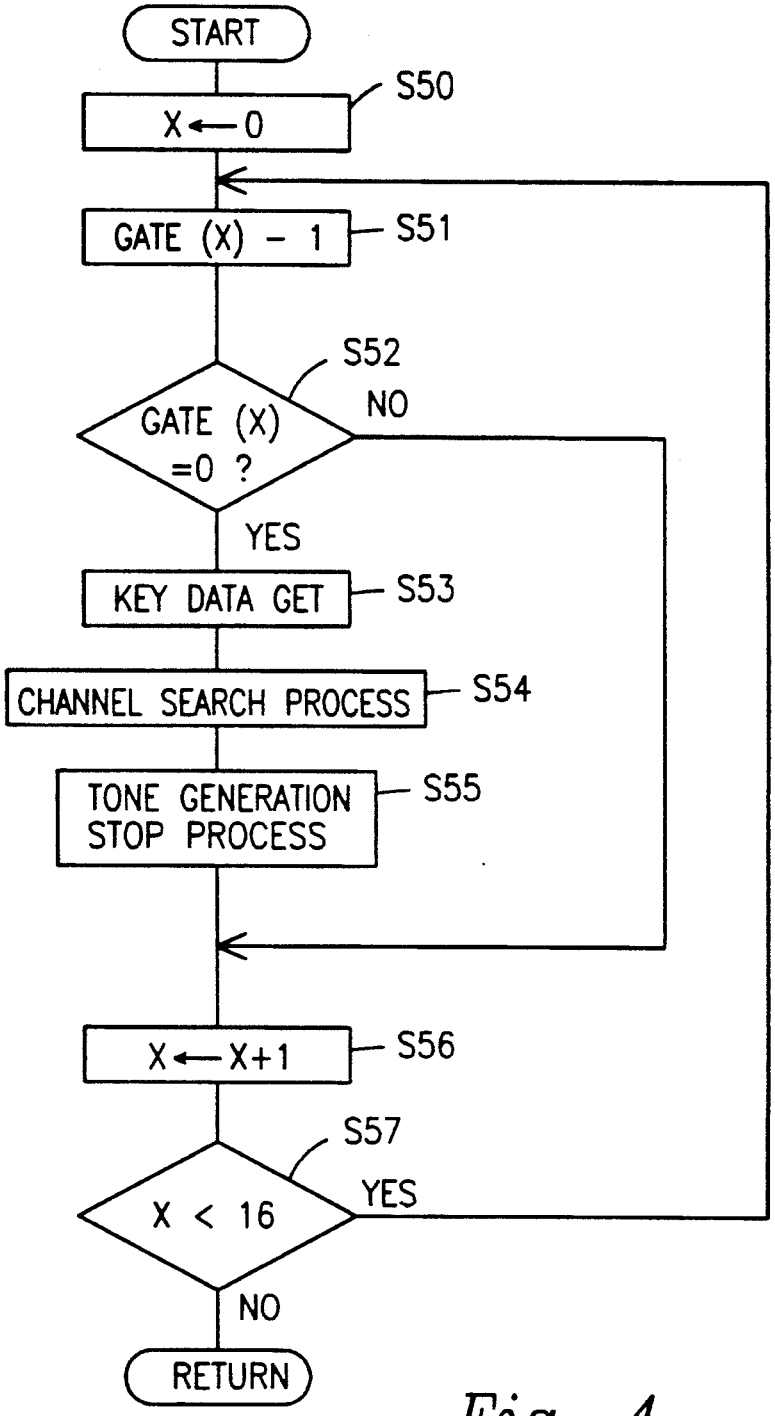
FIG. 4 is a flowchart for explaining the OFF process in FIG. 3.

If, in step S31, the process determines that it is time to perform a read, an OFF process is performed (step S32). During this process, a search is made for channels that are in a tone-ON state, those channels whose gate time GATE equals "0", for stopping tone generation. FIG. 4 is a flowchart showing the OFF process. The OFF process will now be briefly explained. The chord information output apparatus in this embodiment will have 16 tone-ON channels.

First, a counter that uses variable X is cleared (step S50). The counter serves as a pointer into a 16-entry table that stores 16 gate times GATE. The variable X is used to hold the numbers of the tone-ON channels in the table. The tone-ON channel being processed is designated by the count represented by X in "GATE (X)".

The gate time GATE (X) in the entry that is designated by the variable X is decremented (step S51), and a check is performed to determine if the resultant value is "0" (step S52). If that value is not "0", execution control branches to step S56, skipping steps S53 to S55.

If the value of the gate time GATE is "0", key information in the tone-ON channel entry selected by the variable X is fetched (step S53). That is, the tone-ON key information (key number) that is stored in correlation with the entry of the table is fetched.

Then, the tone-ON channel is searched to find where a musical tone corresponding to the fetched key information in step S53 is produced (step S54), and tone generation from that channel is stopped (step S55).

Following this, the variable X count is incremented (step S56), and a check is performed to determine if the resultant value is less than "16" (step S57). In other words, it is determined whether the entries "0" to "15" have been processed.

If the count is less than "16", execution returns to step S51, and the processing is repeated for the next entry. If the count is "16", or greater, all the entries have been processed, and the program control returns from the OFF routine to step S33 of the automatic playing process routine.

Using the above-described OFF process, tone generation is stopped for a key number whose gate time GATE is "0" when read.

When the OFF process is completed, the step time step is incremented, as shown in FIG. 3 (step S33). Step time step is a timing count for providing tone-ON time. Step time step is incremented at time intervals corresponding to music tempo, and is cleared to "0" at the head of each measure.

When the incremented step time step matches step time STEP, included in the currently processed play data, musical tones in accordance with that play data will be generated.

Then, a check is made to decide whether or not step time step equals step time STEP of the next play data to be processed (hereafter referred to as "next step time NEXTSTEP") (step S34). If step time step does not equal the next step time NEXTSTEP, program control returns from the automatic playing process routine, indicating that it is not yet time to produce musical tones based on the next play data.

If step time step equals the next step time NEXTSTEP, play data corresponding to the next step time NEXTSTEP is read from the play data memory 16 (step S35). The play data read out in this step is key information (key number) KEY, measure information or an END mark.

A check is performed to determine whether or not the read data is key information (step S36). This process is performed by checking a predetermined bit that is included in the first byte of the play data. The checks for the measure information (step S42) and the END mark (step S44) are made in the same manner.

If the read data is found to be key information, velocity VELO in the play data is read from the play data memory 16, and the VELO value is set in the tone generator 22 (step S37). Tone volume is thus selected.

Next, gate time GATE in the play data is read from the play data memory 16, and gate time GATE is set in the above-described table that stores gate times (step S38). Gate time GATE is used to decide tone generation stop timing, as described above.

Key information conversion is then performed by the key data developing section 15 (step S39). More specifically, during this process, the play data D5 that is sent from the automatic playing section 17 is converted into a predetermined code in accordance with chord information that is detected by the chord detector 14.

Tone-ON channels are assigned through a channel assigning process (step S40), and then tone-ON processing is performed (step S41). Accordingly, musical tones are released via the tone generator 22, the amplifier 23, and the loudspeaker 24. Program control then branches to step S47.

When, in step S36, the read-out play data is determined not to be key information, a check is made to decide whether that play data is measure information (step S42). If the play data is found to be measure information, step time step is cleared (step S43), and program control branches to step S47. As a result, automatic playing starts at the head of the next measure.

If, in step S42, the play data is not measure information, a check is performed to determine if that play data is an END mark (step S44). When the play data is found to be an END mark, the automatic playing flag is cleared (step S45), and program control branches to step S47. An automatic playing series is then terminated.

When, in step S44, the play data is not an END mark, it is assumed that the play data is timbre select data, and timbre setting processing is performed (step S46). This processing is performed only when play data read from the play data memory 16 indicates a timbre change.

Step time STEP in the next play data is fetched to be used as the next step time NEXTSTEP (step S47). Program execution returns to step S34 and the processing is repeated.

When processing of all play data having the same step time STEP is completed, program control returns to from the automatic playing process routine.

A reception process in step S26, shown in FIG. 2, will now be explained.

Figure 5:
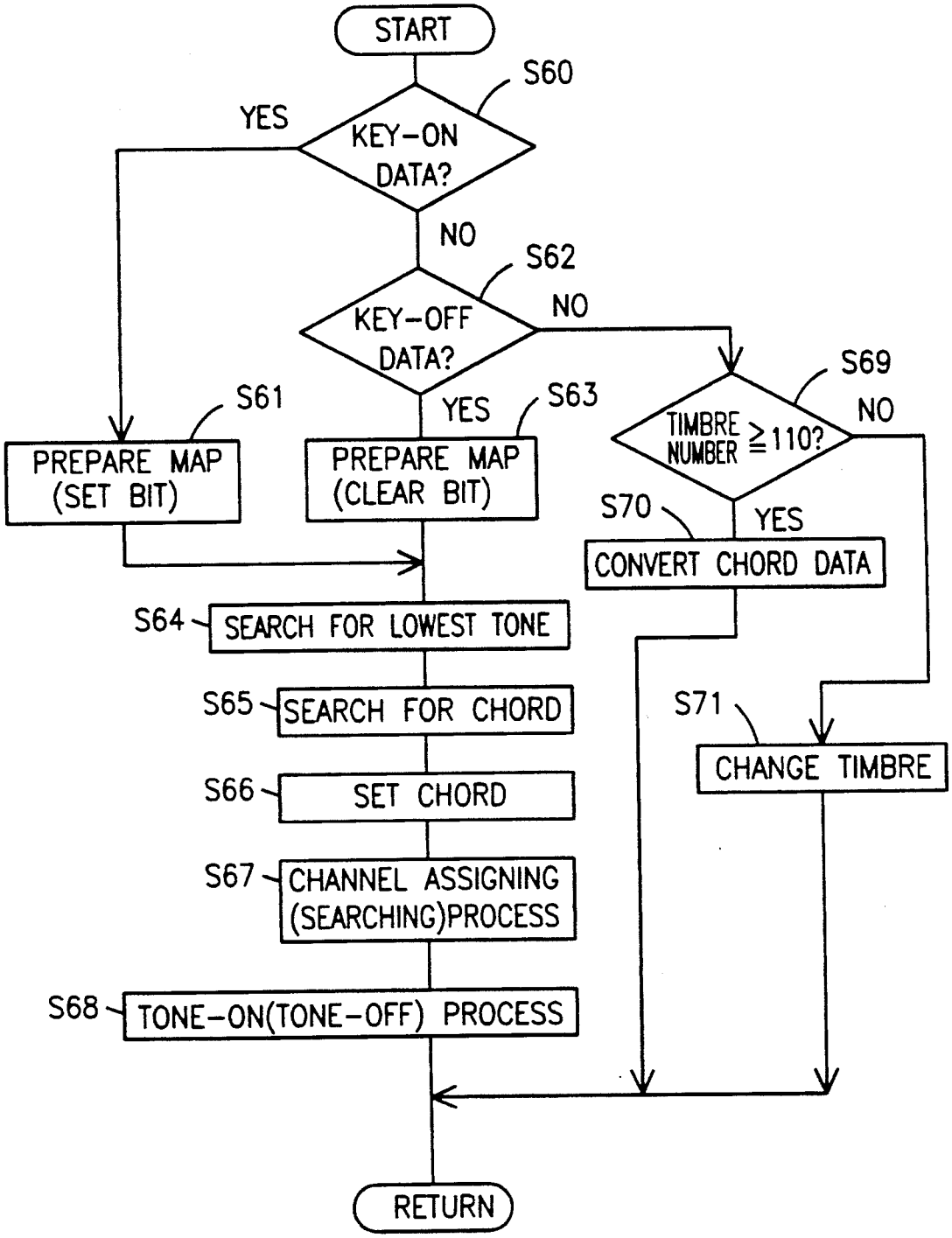
FIG. 5 is a flowchart for explaining the reception process in FIG. 2.

FIG. 5 is a flowchart showing the reception process. Information that is supplied to the external information input section 20 from an external source constitutes, for example, status information, and associated information about key number, velocity, etc.

The status information is used to identify information types, such as "$90_H$", for key-ON information; "$80_H$", for key-OFF information; and "$CO_H$", for timbre information. ("$_H$" denotes the hexadecimal number system.)

If key-ON information or key-OFF information is received as status information, key number information and velocity information are sent sequentially. If timbre information is received as status information, a timbre number is then sent. Timbre numbers "0" to "99" are used to show timbre types, and timbre numbers "100" to "127" are used to show chord types. FIG. 8 is an example of the correlation of timbre numbers and chord types.

In the reception process, first, a check is performed to determine whether or not information received from an external source is key-ON information (step S60). If the received information is key-ON information, a map preparing process is performed (step S61). The chord detection output apparatus of the present invention uses a map that holds information that corresponds to the ON/OFF state of the keys of the keyboard 10, and performs various processes while referring to this map. Since the apparatus according to this invention processes information received from an external source in the same manner as it processes information input via the keyboard 10, it is therefore necessary to prepare a map for information received from an external source.

As shown in FIG. 7A, a map is a buffer that corresponds to an octave on the keyboard 10. One bit in a buffer is used to hold the ON/OFF state of one key in an octave. The number of such buffers provided is determined by the number of keys on the keyboard 10.

In the map preparing process, the key number of key-ON information is divided by "12", and the acquired quotient, i.e., the octave number, is used to select a buffer. The obtained remainder is used to select a buffer bit position to be set. More specifically, a logical sum is obtained from the contents of a buffer, which is selected by the quotient, and a bit pattern, which is obtained by using a set map-bit pattern table shown in FIG. 7B. This sum is stored in the original buffer. The bit of a buffer that corresponds to the key designated by the key number is thus set.

If, in step S60, the information input from the external source is not key-ON information, a check is then made to determine whether or not that information is key-OFF information (step S62). When it is found to be key-OFF information, a map preparing process is performed (step S63).

In this map preparing process, the key number of key-OFF information is divided by "12", the acquired quotient is used to select a buffer, and the obtained remainder is used to select a bit position to be cleared. A logical product is acquired using the contents of a buffer, which is selected by the quotient, and an inverted bit pattern, which is obtained by searching a set map-bit pattern table shown in FIG. 7B. This product is stored in the original buffer. The bit of a buffer that corresponds to the key designated by the key number is thus cleared.

A lowest tone searching process is then performed (step S64). This process is employed to search the above-prepared map for the lowest tone. The lowest tone found is used as a chord root for chord information. All the areas of a keyboard, including a bass area, are regarded as chord areas. A chord root is a root note for an accompaniment chord that is detected in a chord area.

A chord searching process is performed next (step S65). This process is used to decide a chord type. During the chord searching process, the prepared map (octave code) is compared sequentially with, for example, the entries in a previously prepared chord detection table, as shown in FIG. 9, to search for a matching octave code.

A chord setting process is performed to temporarily store detected chord information (chord type and chord root) in a predetermined buffer (step S66). The detected chord information is used to develop automatic play data when the chord information output apparatus is in automatic play mode. This information may be output to an external device. The chord detection process is then terminated.

A channel assigning process (a channel searching process in the case of key-OFF information) is performed (step S67), and then a tone-ON process (a tone-OFF process in the case of key-OFF information) is performed (step S68). Through these processes, musical tone production is initiated or halted in accordance with the received key-ON information or key-OFF information. Program control then returns to the reception routine.

If, in step S62, the information supplied from an external source is not key-OFF information, it is assumed that that information is timbre information. A check is then performed to determine whether its timbre number is "100" or greater (step S69). When the timbre number is less than "100", i.e., "0" to "99", a timbre change process is performed to change the timbre of a musical tone to be produced to a timbre that corresponds to the timber number (step S71). Program control then returns to the reception routine.

If the timbre number is "100" or greater, a chord information converting process is performed to prepare chord information from the timbre number of the received timbre information (step S70). This chord information is input via the keyboard 10, and that information, as well as the chord information in the chord detection process, is used to develop automatic play data.

A key process in step S11 of the main routine shown in FIG. 2 will now be explained.

Figure 6A:
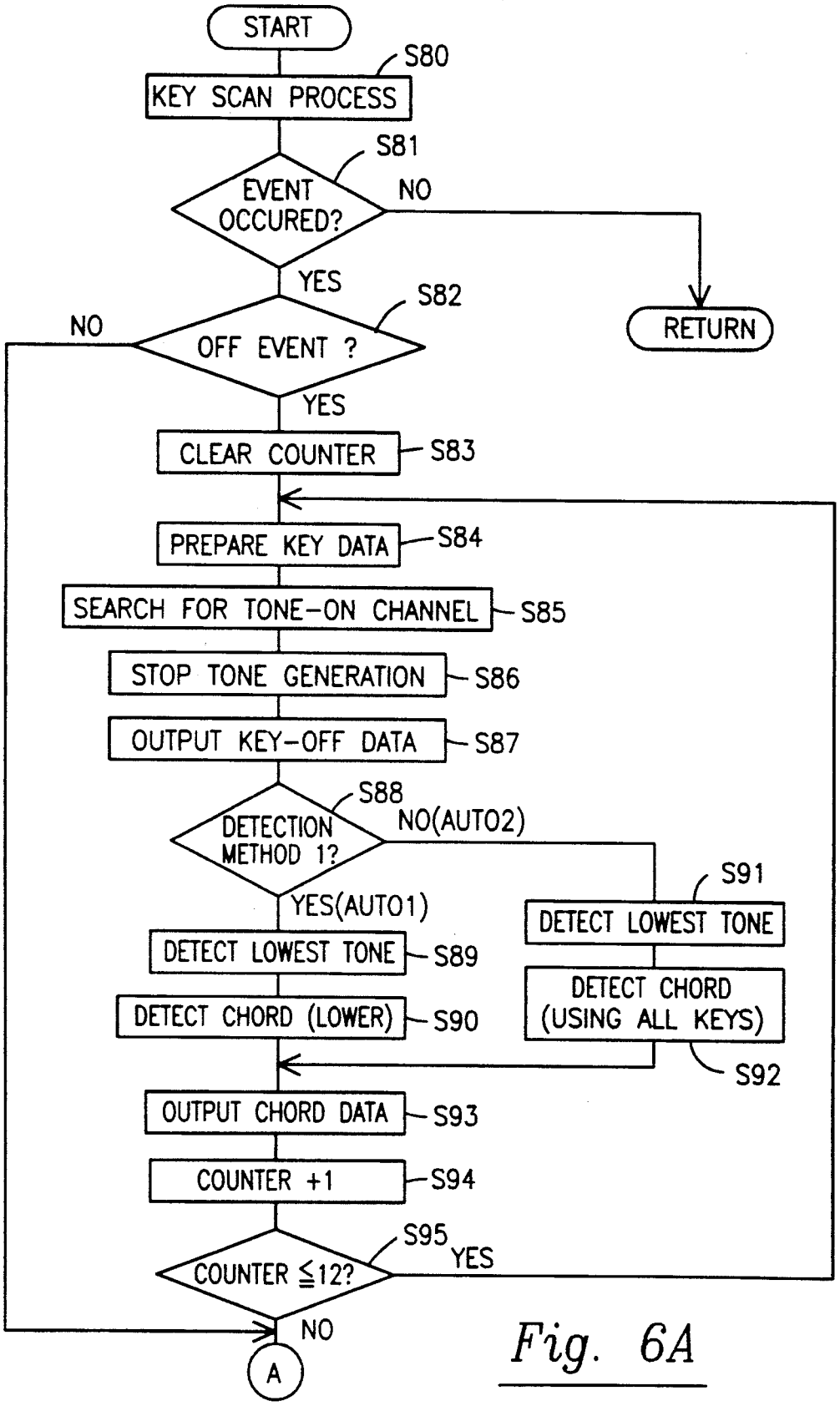
FIGS. 6A and 6B are flowcharts for explaining the key process in FIG. 2.
Figure 6B:
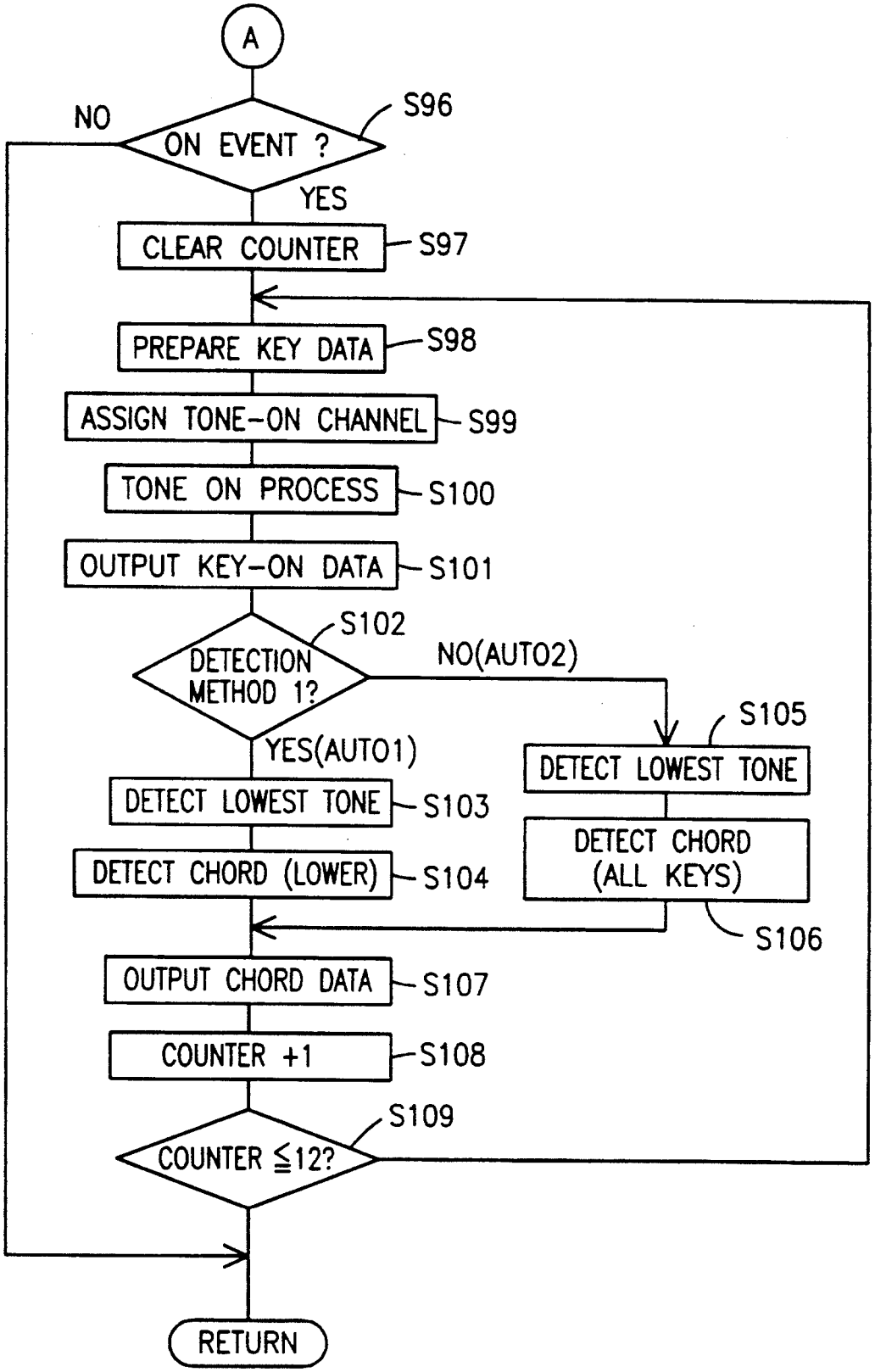

FIGS. 6A and 6B are flowcharts showing the key process. During this process, key scan processing is performed (step S80). More specifically, the key depression detector 11 fetches key scan data D1 from the keyboard 10 and stores it in the RAM (not shown).

A check is then performed to determine whether or not an event has occurred at the keyboard 10 (step S81). That is, the current key scan data D1, fetched from the keyboard 10 and held in the RAM, is compared with the previously fetched key scan data D1, to determine whether there is a changed key (a changed bit in the key scan data D1). When it is found that no event has occurred, program control returns to the key process routine without performing the subsequent processes.

If an event has occurred, a check is performed to determine whether it is an OFF event (step S82). When it is found that the event is not an OFF event but is instead an ON event, the procedure branches to step S96 where an OFF event process is performed, as will be described later.

If it is found in step S82 that the event is an OFF event, OFF event processing is performed following step S83. First, a counter is cleared (step S83). The counter is used to count a key range for chord detection.

Then, key information is prepared (step S84). During this process, key numbers of the keys in the OFF state are extracted from the key scan data D1 that is output by the key depression detector 11.

Tone-ON channels are searched to determine where musical tones corresponding to the above key numbers are produced (step S85), and tone generation is stopped (step S86).

Key-OFF information is output (step S87). That is, information, such as key numbers and velocity, together with key-OFF status information, is supplied to an external device via the internal information output section 19.

A further check is made to determine whether or not detection method 1 has been selected for chord detection (step S88). This check is performed by referring to a flag that is stored in the RAM at either step S21 or step S23 in FIG. 2, and that indicates which detection method has been selected.

If it is determined that detection method 1 has been selected, the lowest tone is detected (step S89). The detected lowest tone is used as a chord root. Then, a chord detection process is performed (step S90). During this process, a normal chord detection method employing the LOWER keys on the keyboard 10 for chord detection is used.

If, in step S88, it is determined that detection method 1 has not been selected, it is then assumed that detection method 2 has been selected, and the lowest tone detecting process is performed (step S91). The detected lowest tone is used as a bass root. Then, a chord detection process is performed (step S92). During this process, a chord detection method that employs all the keys on the keyboard 10 for chord detection is used.

Then, a process for outputting the above detected chord information is performed (step S93). In other words, either chord information that consists of a chord root and a chord type, or chord information that consists of a bass root showing a fraction chord and a chord type is sent via the internal information output section 19 to an external device.

A bass root is a root note for a bass chord used for accompaniment that is detected in the bass area. A bass area is allocated to a one-octave, low sound range (C1 to B1) on a keyboard. A fraction chord is a bitonal chord where the bass root and the chord root are not related. For example, a chord written "C/B" is a fraction chord.

The counter is then incremented (step S94). Following this, a check is made to determine whether the content of the counter is "12" or less, i.e., to determine whether a process for one octave has been completed (step S95). If the content of the counter is "12" or less, the procedure returns to step S84 and the OFF event processing is repeated. When the content of the counter has become greater than "12" through this process repetition, the process advances to the next step.

ON event processing is performed following step S96.

First, a check is made to determine whether or not an event is an ON event (step S96). If the event is not an ON event, the subsequent processes are not performed and program control returns from the key process routine.

If it is found that the event is an ON event, the counter is cleared in the same manner as for the OFF event processing (step S97), and key information is prepared (step S98).

Channel assigning is next performed (step S99). More specifically, unused tone-ON channels are searched for, or the use for currently-used tone-ON channels is halted. Musical tones corresponding to the key information are assigned to the tone-ON channels. Then, tone generation is performed (step S100).

Key-ON information is output (step S101). That is, information, such as key numbers and velocity, together with key-ON status information, is supplied to an external device via the internal information output section 19.

In the same manner as for the OFF event processing, a check then performed to determine whether detection method 1 has been selected for chord detection (step S102). When detection method 1 has been selected, the lowest tone is detected (step S103), and then a chord detection process is performed (Step S104).

If it is found that detection method 1 has not been selected, the lowest tone is detected (step S105), and a chord detection process is performed (step S106). Following this, chord information detected above is output (step S107).

The counter is then incremented (step S108), and a check is made to determined whether the content of the counter is "12" or less, i.e., to determine whether a process for one octave has been completed (step S109). If the content of the counter is "12" or less, the procedure returns to step S98 and the ON event processing is repeated. When the content of the counter has become greater than "12" through this process repetition, program control returns from the key process routine.

To simplify the explanation, the above-described key process is presented for only one octave; however, this key process will be performed for as many octaves as are required for the key count of the keyboard 10.

As described above, according to this embodiment, a chord information output apparatus detects a chord upon key depression on the keyboard 10, and then outputs the chord as chord information to an external device from the internal information output section 19. When chord information sent from the chord information output apparatus is to be supplied to, for example, a keyboardless automatic accompaniment apparatus described in (2), the chord information can be input to the automatic accompaniment apparatus via the keyboard of the chord information output apparatus rather than via the input means of the automatic accompaniment apparatus. Since players can enter chord information through familiar keyboard operation, smooth entry of chord information is possible.

When chord information output by the chord information output apparatus is supplied to, for example, an electronic musical instrument that has a keyboard and that incorporates an automatic accompaniment apparatus, part of the instrument's keyboard does not have to be used for chord information entry and the full key range of the keyboard can be used to play a melody.

Since chord information is output to an external device, musical tone information can be transmitted faster than when tone information is individually output, and the load placed on the automatic accompaniment apparatus is reduced.

As described above in detail, according to the present invention, a chord information output apparatus can be provided that supplies chord information, which is detected following key depression, to an external device such as a keyboardless automatic accompaniment apparatus or an electronic musical instrument that has a keyboard and that incorporates an automatic accompaniment apparatus, so that a keyboardless automatic accompaniment apparatus can receive chord information without using its own input means, and so that the full key range of an electronic musical instrument that incorporates an automatic accompaniment apparatus can be used to play a melody.

(2) Automatic Accompaniment Apparatus

Figure 10:
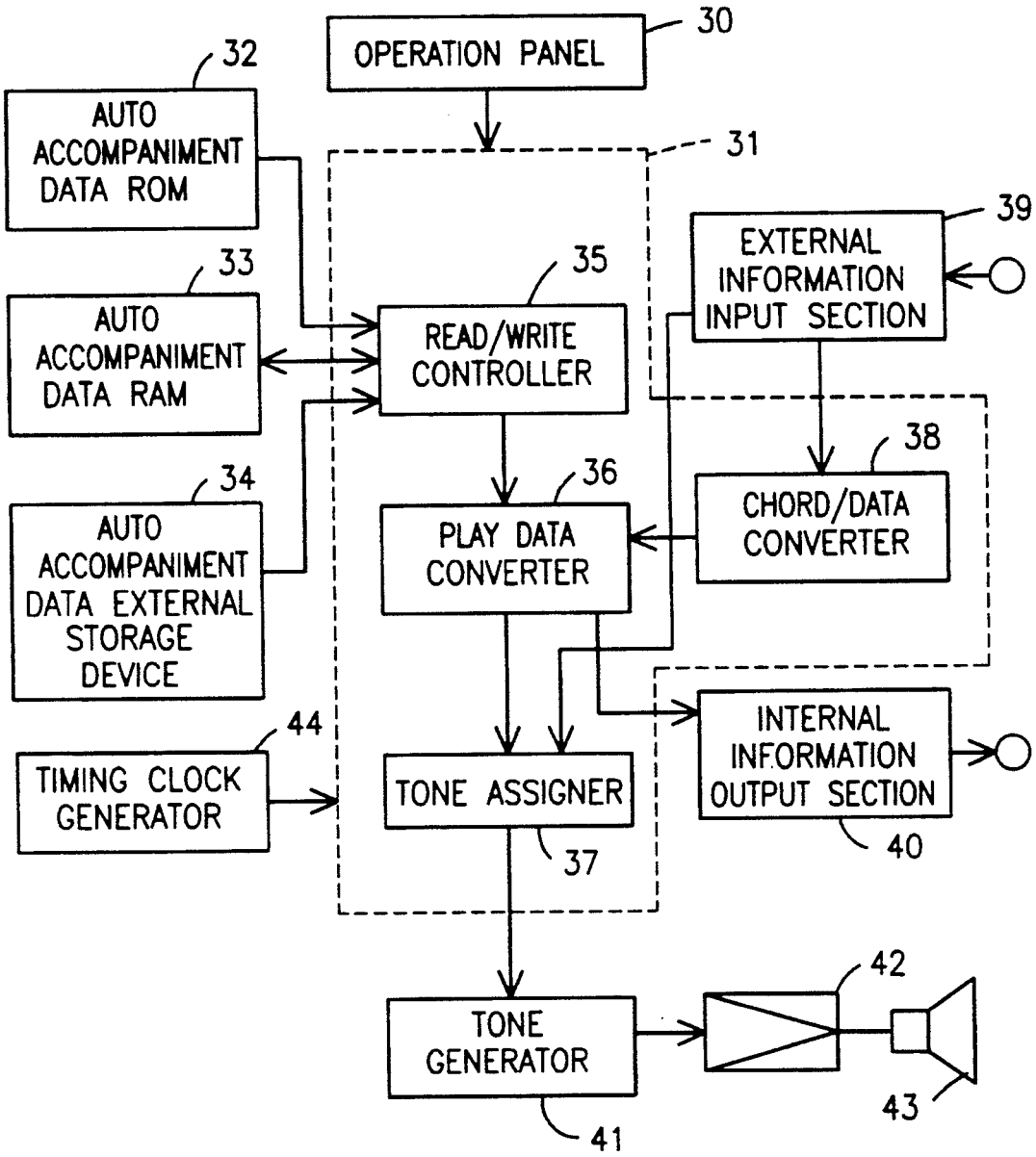
FIG. 10 is a schematic block diagram illustrating the general arrangement of one embodiment of an automatic accompaniment apparatus according to the present invention.

FIG. 10 is a schematic block diagram illustrating the general structure of one embodiment of an automatic accompaniment apparatus according to the present invention. This automatic accompaniment apparatus does not have keyboard.

An operation panel 30 has various switches for controlling the automatic accompaniment apparatus, a display, etc. The switches include a START/STOP switch that is used to start or stop automatic playing, as well as the general switches provided for an electronic musical instrument, e.g., a timbre select switch, a rhythm select switch, and a volume switch (none of then shown).

The START/STOP switch is a toggle switch and its state changes each time it is depressed.

A panel scan signal (not shown) is sent to the operation panel 30 by a CPU (Central Processing Unit) 31. In response to the panel scan signal, the operation panel 30 outputs panel scan data that indicates the settings of the switches. The panel scan data is stored in a RAM (not shown) controlled by the CPU 31.

The CPU 31 controls the automatic accompaniment apparatus as a whole, and performs the software functions of a read/write controller 35, a play data converter 36, a tone assigner 37 and a chord information converter 38. The details of these components will be described later.

An automatic accompaniment data ROM 32, an automatic accompaniment data RAM 33, an automatic accompaniment data external storage device 34, an external information input section 39, an internal information output section 40, a tone generator 41, and a timing clock generator 44 are connected to the CPU 31.

The automatic accompaniment data ROM 32 is used to store automatic accompaniment data, and several basic automatic play patterns are stored therein.

The automatic accompaniment RAM 33 is also used to store automatic accompaniment data. Automatic play data arbitrarily prepared by a player, or automatic play data supplied from an external source is stored in this RAM 33.

An automatic accompaniment data external storage device 34 is a memory for storing automatic accompaniment data, it consists of a large capacity storage device, such as a floppy disk or a compact disk (CD).

With the inclusion of key data (key number) KEY, or measure information, or an END mark, step time STEP, gate time GATE and velocity VELO serve as a unit of play data. A plurality of these play data constitute automatic play data. The automatic play data are stored in the automatic accompaniment data ROM 32, the automatic accompaniment data RAM 33, or the automatic accompaniment data external storage device 34. The meanings and functions of the above data have been previously described.

The automatic accompaniment data ROM 32, the automatic accompaniment data RAM 33 and the automatic accompaniment data external storage device 34 are connected to the read/write controller 35 of the CPU 31.

The external information input section 39 is an interface circuit that receives key data, timbre data, etc. from, for example, an electronic musical instrument that has a keyboard. The key data received by the external information input section 39 is supplied as external key data to the chord data converter 38 of the CPU 31. The received timbre data is supplied via the tone assigner 37 to the tone generator 41.

The internal information output section 40 is an interface that sends tone information which is output by the play data converter 36 of the CPU 31 to an external device, following instructions from the operation panel 30. Automatic playing can therefore be accomplished by the external device, together with accompaniment that is output by the automatic accompaniment apparatus.

The read/write controller 35 controls the reading of play data from the automatic accompaniment data ROM 32 and the automatic accompaniment data external storage device 34, following the instruction from the operation panel 30, and concurrently controls the data writing and reading with respect to the automatic accompaniment data RAM 33. Play data that is read by the read/write controller 35 is supplied to the play data converter 36.

The chord data converter 38 detects a chord based on key data from the external information input section 39. The output of the chord data converter 38 is sent as chord information to the play data converter 36.

Upon the receipt of the chord information from the chord data converter 38, the play data converter 36 performs predetermined conversion of play data read from the read/write controller 35 to produce tone information. More specifically, based on chord information output from the chord data converter 38, the play data converter 36 modifies play data, which is prepared with, for example, "C" as a base reference, to a predetermined code, and produces tone information. The tone information is supplied to the internal information output section 40 and the tone assigner 37.

The tone assigner 37 assigns predetermined tone-ON channels to tone information sent from the play data converter 36, or to external key information sent from the external information input section 39. The tone information from the tone assigner 37 is supplied to the tone generator 41.

Upon receipt of the tone information from the tone assigner 37, the tone generator 41 reads tone wave data and envelope data from a wave memory (not shown), and adds an envelope to the read-out tone wave data to output the resultant data as a tone signal. This tone signal is sent from the tone generator 41 to an amplifier 42.

The amplifier 42 amplifies the received tone signal by a predetermined gain, and then supplies the resultant signal to a loudspeaker 43. The loudspeaker 43 is a well known transducer that converts an electric signal into an acoustic signal.

The timing clock generator supplies a read timing clock to the CPU 31. In the automatic accompaniment process, in synchronism with this read timing clock, play data is read from the automatic accompaniment data ROM 32, the automatic accompaniment data RAM 33, or the automatic accompaniment data external storage device 34, thereby performing automatic playing.

With such an arrangement, the operation of this embodiment according to the present invention will now be described referring to the flowcharts in FIGS. 11 and 12.

Figure 11:
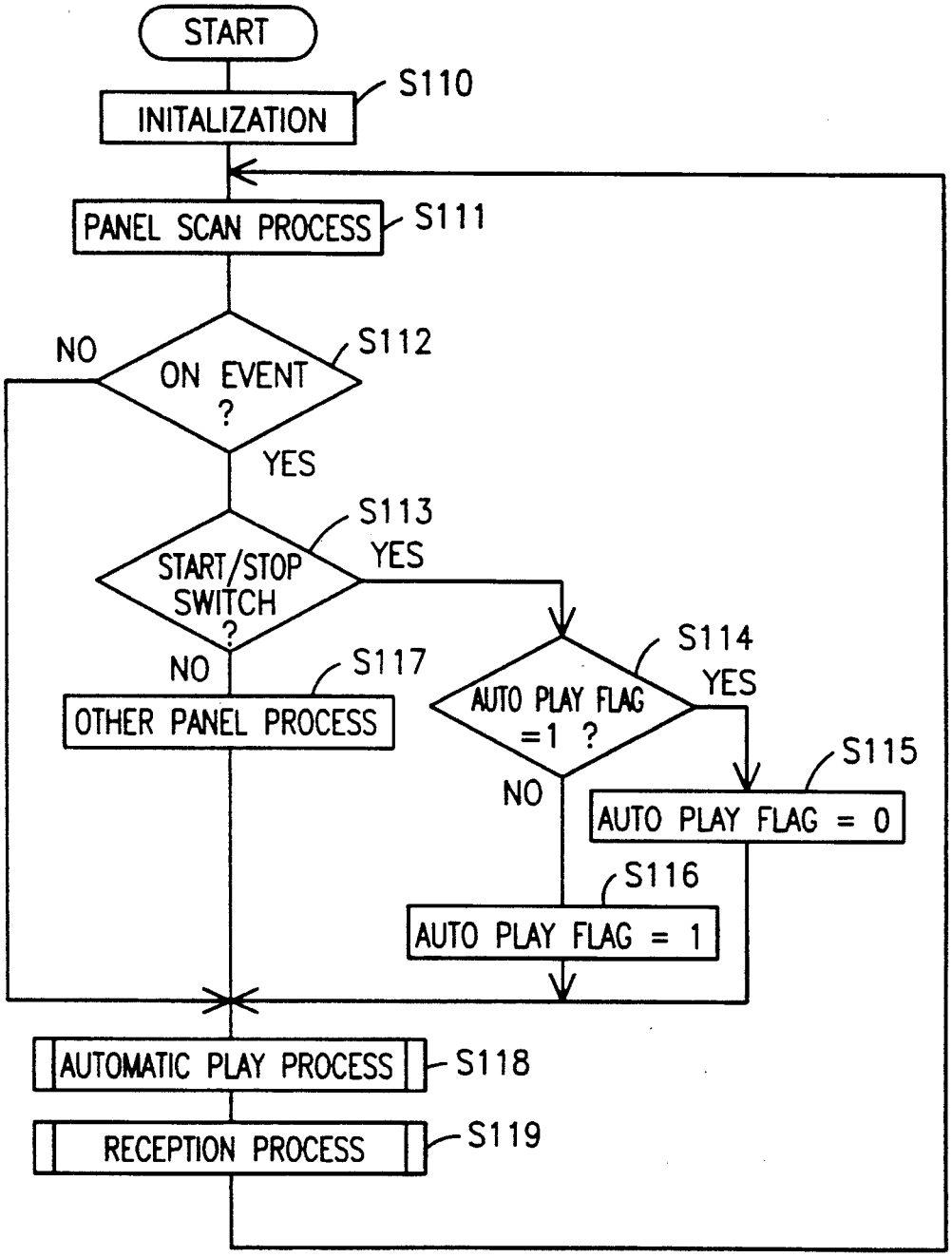
FIG. 11 is a flowchart of the main routine of one embodiment of an electronic musical instrument that is used as an automatic accompaniment apparatus of the present invention.

When power is switched on, an initialization process is performed as shown in the flowchart in FIG. 11 (step S110). This process establishes the initial internal state of the tone generator 41 and prevents unwanted musical tones from being produced when power is switched on, and sets the initial values of a buffer, a register, a counter, a flag, etc. which are defined in a RAM (not shown).

Then, a panel scan process is performed (step S111). More specifically, the CPU 31 fetches panel scan data from the operation panel 30 and stores it in the RAM (not shown).

A check is then performed to determine whether or not an ON event has occurred at the operation panel 12 (step S112). That is, the current panel scan data D2, fetched from the operation panel 30 and held in the RAM, is compared with the previously fetched panel scan data, to determine whether a switch has been newly set ON.

When in step S112, it is found that no ON event has occurred, program control branches to step 118 and moves to an automatic playing process.

When it is found that an ON event has occurred, a check is made to determine whether or not the switch in the ON state is the START/STOP switch (step S113).

If the switch in the ON state is the START/STOP switch, the status of the automatic playing flag is then checked (step S114). If the automatic playing flag is set to "1", this flag is reset to "0" (step S115), and program control shifts to the automatic playing process in step S118. In this case, the automatic playing process in the automatic playing process routine is not performed.

If the automatic playing flag is not "1", the flag is set to "1" (step S116), and program execution moves to the automatic playing process in step S118. In this case, the automatic playing process in the automatic playing process routine is performed.

Through the processes in steps S113 to S116, the toggle function of the START/STOP switch is accomplished. The automatic playing flag is used to indicate whether the play mode of the chord information output apparatus is automatic or normal. The automatic playing flag is provided in the RAM (not shown).

If it is found in step S113 that no ON event has occurred at the START/STOP switch, processing associated with an ON-event switch is performed (step S117). The processing includes, for example, timbre selection, rhythm selection or volume control. Program control then branches to step S118 to shift to an automatic playing process.

The automatic playing process is the same as the one shown in the flowcharts in FIGS. 3 and 4, except that a key data converting process in step S39 in FIG. 3 is performed by the play data converter 36. That is, the key data converting process is established by converting play data sent from the read/write controller 35 into a predetermined code in accordance with chord information detected by the chord data converter 38.

When the automatic playing process is completed, a reception process is performed (step S119), and program control returns to step S111 to repeat the processing.

A reception process in step S119, shown in FIG. 11, will now be explained. This process is performed in the same manner as the reception process for the chord information output apparatus shown in FIG. 5.

Figure 12:
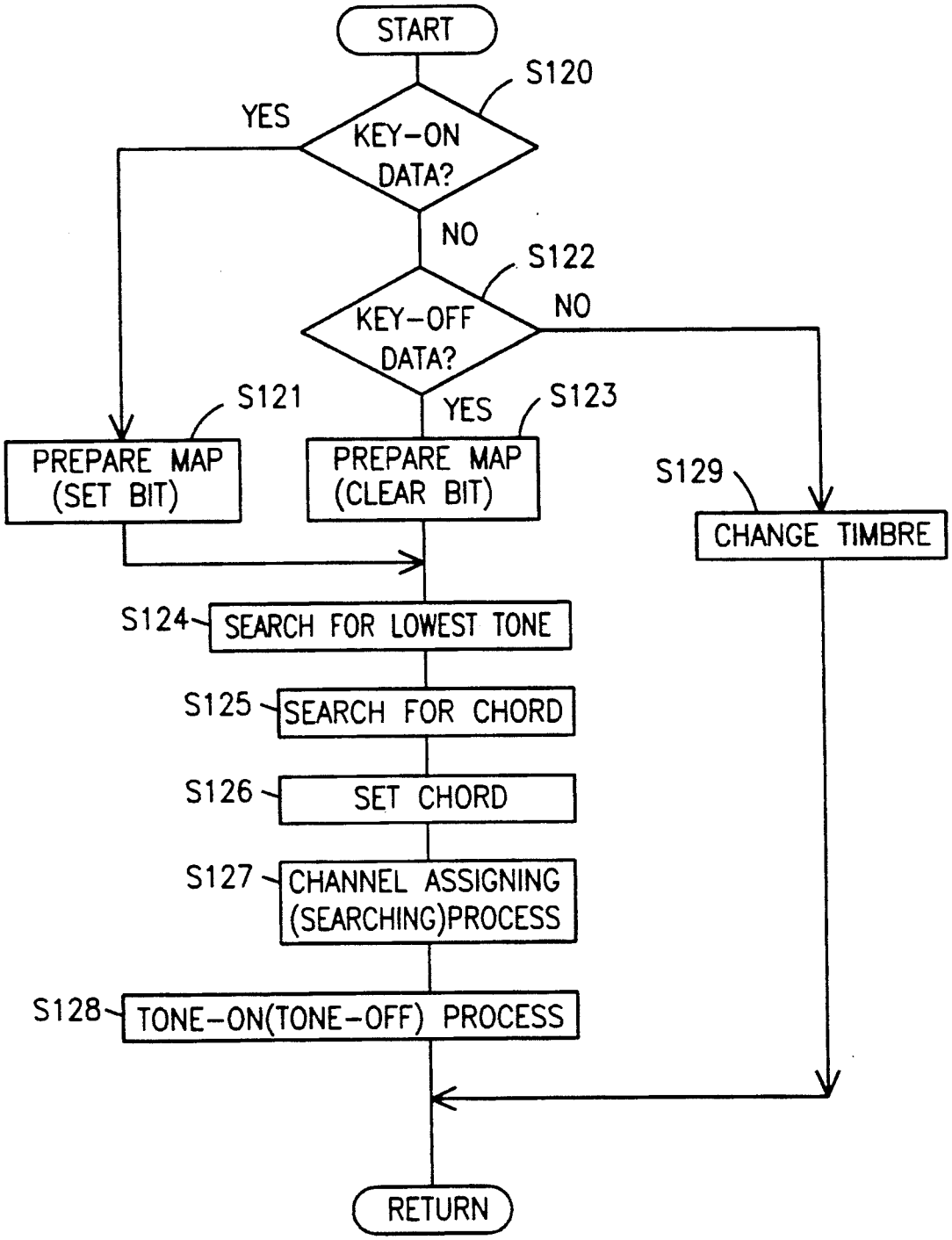
FIG. 12 is a flowchart for explaining the reception process in FIG. 11.

FIG. 12 is a flowchart showing the reception process. Information that is supplied to the external information input section 39 from an external source constitutes, for example, status information, and associated information about key number, velocity, etc.

The status information is used to identify information types, such as "$90_H$", for key-ON information; "$80_H$", for key-OFF information; and "$CO_H$", for timbre information, ("$_H$" denotes the hexadecimal number system.)

If key-ON information or key-OFF information is received as status information, key number information and velocity information are sent sequentially. If timbre information is received as status information, timbre numbers then follow. Timbre numbers are used to show timbre types.

In the reception process, a check is performed to determined whether information received from an external sources is key-ON information (step S120). If the received information is key-ON information, a may preparing process is performed (step S121). The automatic accompaniment apparatus, as well as an electronic musical instrument having a keyboard, uses a map that holds information that corresponds to the ON/OFF state of the keys of the keyboard, and performs various processes while referring to this map.

As shown in FIG. 7A, a map is a buffer that corresponds to an octave on the keyboard. One bit in a buffer is used to hold the ON/OFF state of one key in an octave. The number of such buffers provided is determined by the number of keys on the keyboard.

In the map preparing process, the key number in the key-ON information is divided by "12". The acquired quotient, i.e., the octave number, is used to select a buffer. The obtained remainder is used to select a buffer bit position to be set. More specifically, a logical sum is obtained from the contents of a buffer, which is selected using the quotient, and a bit pattern, which is obtained by using the set may-bit pattern table shown in FIG. 7B. The resulting sum is then stored in the original buffer. The bit of a buffer that corresponds to the key designated by the key number is thus set.

If, in step S120, the information input from the external source is not key-ON information, a check is then made to determine whether or not that information is key-OFF information (step S122). When it is key-OFF information, a map preparing process is performed (step S123).

In this map preparing process, the key number of key-OFF information is divided by "12", the acquired quotient is used to select a buffer, and the obtained remainder is used to select a bit position to be cleared. A logical product is acquired using the contents of a buffer, which is selected using the quotient, and an inverter bit pattern, which is obtained by searching the set map-bit pattern table shown in FIG. 7B. This product is stored in the original buffer. The bit of a buffer that corresponds to the key designated by the key number is thus cleared.

A lowest tone searching process is then performed (step S124). This process searches the above-prepared map for the lowest tone. The lowest tone found is used as a code route for chord information.

A chord searching process is performed next (step S125). This process is used to decide a chord type. During the chord searching process, the prepared map (octave code) is compared sequentially with, for example, a previously prepared chord detection table, as shown in FIG. 9, to search for a matching octave code.

A chord setting process is performed to temporarily store detected chord information (chord type and code route) in a predetermined buffer (step S126). The detected chord information is used by the play data converter 36 to develop automatic play data. The chord detection process is then terminated.

A channel assigning process (a channel searching process in the case of key-OFF information) is performed (step S127), and then a tone-ON process (a tone-OFF process in the case of key-OFF information) is performed (step S128). Through these processes, musical tone production is initiated or halted in accordance with the received key-ON information or key-OFF information. Program control then returns to the reception routine.

If, in step S122, the information supplied by an external source is not key-OFF information, it is assumed that that information is timbre information. A timbre change process is performed to change the timbre of a musical tone to be produced to a timbre that corresponds to the timber number (step S129). Program control then returns to the reception routine.

As described above, in this embodiment, the automatic accompaniment apparatus receives, for example, key information as data from an external device, converts this data into chord information, generates tone information by converting play data read from the automatic accompaniment data ROM 32, the automatic accompaniment data RAM 33, or the automatic accompaniment data external storage device 34, in accordance with the chord information, and produces a musical tone based on the tone information.

The automatic accompaniment apparatus therefore receives key information through the keyboard of an external device, such as an electronic musical instrument that has a keyboard, and detects a chord using this key information, thereby performing automatic accompaniment. A player does not therefore have to use the means for entering chord information, such as a keypad or an operation terminal assembly, that the automatic accompaniment apparatus includes, but can smoothly enter chord information by familiar keyboard operation.

In the above embodiment, an arrangement that does not have a keypad or a terminal assembly for inputting chord information has been explained; however, such means may also be included in this arrangement.

As described above, according to the present invention, it is possible to provide the automatic accompaniment apparatus that can perform automatic accompaniment using chords that are detected based on information input from an external source.

What is claimed is:

1. A device that facilitates the playing of chords by a musician, comprising:

a chord information output apparatus having a first keyboard;

said first keyboard being a full keyboard of conventional design so that a musician may play chords on said first keyboard in the absence of constraints imposed by said design;

key detecting means for detecting key depression on said first keyboard;

chord detecting means for detecting chord information from key information detected by said key detecting means;

an external device having a second keyboard and having an automatic accompaniment function;

said external device having an input means that a musician may use to input chord information into said external device;

said input means of said external device being characterized by the absence of a full keyboard of conventional design and said design therefore presenting to said musician at least some constraint in the playing of chords;

said chord information output apparatus including an output means for outputting chord information directly to said external device so that said input means of said external device is not used;

whereby chord information from said chord information output apparatus is output to said external device so that a musician need not use said input means of said external device, thereby enabling said musician to play a musical piece in the absence of constraints associated with said input means of said external device, and whereby all of said second keyboard of the external device may be used by said musician to play a melody because none of its keys need to be used to generate chords and whereby all of said first keyboard of said chord information output apparatus may be used by said musician so that said musician is unrestricted in the playing of chords on said first keyboard.

2. A chord information output apparatus according to claim 1, wherein chord information output by said output means consists of a chord type and a chord root.

3. A chord information output apparatus according to claim 1, wherein chord information output by said output means includes a bass root showing a fraction chord.

4. A chord information output apparatus according to claim 1, wherein chord information output by said output means indicates a chord detection method.

5. A chord information output apparatus according to claim 4, wherein said chord detection method is a method for using a LOWER key range of a keyboard to detect a chord.

6. A chord information output apparatus according to claim 4, wherein said chord detection method uses a full key range of said keyboard to detect a chord.

7. An automatic accompaniment apparatus, comprising:

storage means for storing play data;

a musician-operated external source of information;

input means for receiving information from said external source;

first converting means for receiving information from said input means and for converting, into chord information, said information received from said input means;

second converting means for receiving said chord information from said first converting means and for changing play data read from said storage means in response to changes in said chord information; and tone generating means for producing a musical tone based on said play data changed by said second converting means;

whereby said apparatus provides automatic accompaniment that changes in response to changes in the information from said external source.

8. An automatic accompaniment apparatus according to claim 7, wherein said storage means is a ROM.

9. An automatic accompaniment apparatus according to claim 7, wherein said storage means is a RAM.

10. An automatic accompaniment apparatus according to claim 7, wherein said storage means is a floppy disk.

11. An automatic accompaniment apparatus according to claim 7, wherein said storage means is a compact disk.

12. An automatic accompaniment apparatus according to claim 7, further comprising output means for outputting to an external device said play data converted by said second converting means.

13. An automatic accompaniment apparatus according to claim 7, wherein said first converting means includes means for converting, into an octave code, key information sent by said input means received from an external source, and further comprises means for searching a chord conversion table for chord information.

* * * * *

UNITED STATES PATENT AND TRADEMARK OFFICE

CERTIFICATE OF CORRECTION

PATENT NO. : 5,319,152

DATED : June 7, 1994

INVENTOR(S) : Shinya Konishi

It is certified that error appears in the above-indentified patent and that said Letters Patent is hereby corrected as shown below:

Title Page, Under Assignee please correct patent to state:

Assignee: Kabushiki Kaisha Kawai Gakki Seisakusho
200 Terajima-cho, Hamamatsu-shi
Shizuoka-Ken, Japan Signed and Sealed this Fifteenth Day of November, 1994

*Attest:*

Bruce Lehman

BRUCE LEHMAN

*Attesting Officer*

*Commissioner of Patents and Trademarks*